US009789500B2

(12) United States Patent
Yamauchi

(10) Patent No.: US 9,789,500 B2
(45) **Date of Patent: *Oct. 17, 2017**

(54) ROTARY ATOMIZING HEAD TYPE COATING MACHINE

(71) Applicant: ABB K.K., Shinagawa-ku (JP)

(72) Inventor: Kuniharu Yamauchi, Nagakute (JP)

(73) Assignee: ABB K.K., Shinagawa-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/944,794

(22) Filed: Nov. 18, 2015

(65) Prior Publication Data

US 2016/0067724 A1 Mar. 10, 2016

Related U.S. Application Data

(62) Division of application No. 14/236,244, filed as application No. PCT/JP2012/079507 on Nov. 14, 2012, now Pat. No. 9,399,231.

(30) Foreign Application Priority Data

Jan. 25, 2012 (JP) ..... 2012-012924

(51) Int. Cl.
*B05B 3/10* (2006.01)
*B05B 5/04* (2006.01)
(Continued)

(52) U.S. Cl.
CPC ..... *B05B 3/1092* (2013.01); *B05B 3/1035* (2013.01); *B05B 3/1064* (2013.01);
(Continued)

(58) Field of Classification Search
CPC ..... B05B 3/02; B05B 3/1092; B05B 3/10; B05B 3/1035; B05B 3/1064; B05B 3/001;
(Continued)

(56) References Cited

U.S. PATENT DOCUMENTS 4,555,058 A 11/1985 Weinstein et al.
4,896,834 A 1/1990 Coeling et al.
(Continued)

FOREIGN PATENT DOCUMENTS

JP 61-61659 3/1986
JP 04-001664 1/1992
(Continued)

OTHER PUBLICATIONS

Korean Office Action issued in Application No. 10-2013-7034306 on Dec. 15, 2014.
(Continued)

*Primary Examiner* — Arthur O Hall
*Assistant Examiner* — Christopher R Dandridge
(74) *Attorney, Agent, or Firm* — Oblon, McClelland, Maier & Neustadt, L.L.P.

(57) ABSTRACT

A bearing air passage through which bearing air is supplied toward an air bearing of an air motor and a turbine air passage through which driving air is supplied toward a turbine are provided in a housing. An annular space surrounding the air motor is provided between the housing and a cover. A bearing air branch passage connecting the annular space and the bearing air passage to each other and a turbine air branch passage for connecting the annular space and the turbine air passage to each other are provided. The air branch passages lead a part of the compressed air to the annular space and keep the cover in a heated state.

5 Claims, 10 Drawing Sheets

(51) Int. Cl.
*B05B 3/00* (2006.01)
*B05B 5/00* (2006.01)

(52) U.S. Cl.
CPC ..... *B05B 5/0415* (2013.01); *B05B 5/0426* (2013.01); *B05B 3/001* (2013.01); *B05B 3/1014* (2013.01); *B05B 5/001* (2013.01)

(58) Field of Classification Search
CPC ..... B05B 3/1014; B05B 5/04; B05B 5/0415; B05B 5/0426; B05B 5/001; B05B 5/0403; B05B 5/025
USPC ..... 239/222, 223, 224, 380, 104, 106, 239/700–703, 112–118, 132–135
See application file for complete search history.

(56) References Cited

U.S. PATENT DOCUMENTS 5,111,994 A * 5/1992 Gonzalez ..... E03C 1/084 239/428.5
6,533,861 B1 3/2003 Matsuda et al.
7,703,700 B2 * 4/2010 Yasuda ..... B05B 3/1064 239/128
9,399,231 B2 * 7/2016 Yamauchi ..... B05B 3/1035
2009/0071397 A1 * 3/2009 Yasuda ..... B05B 3/1014 118/300

FOREIGN PATENT DOCUMENTS

| | | |
|---|---|---|
| JP | 09-262509 | 10/1997 |
| JP | 03-725819 | 12/2005 |
| JP | 2010-284637 | 12/2010 |
| WO | 2006/129407 | 12/2006 |

OTHER PUBLICATIONS

International Search Report issued in PCT/JP2012/079507 on Feb. 26, 2013.

* cited by examiner

ROTARY ATOMIZING HEAD TYPE COATING MACHINE

CROSS-REFERENCE TO RELATED APPLICATIONS

This application is a division of U.S. application Ser. No. 14/236,244 filed Jan. 30, 2014, the entire contents of which is incorporated herein by reference. U.S. application Ser. No. 14/236,244 is a National Stage of PCT/JP12/079507 filed Nov. 14, 2012 and claims the benefit of priority to Japanese Patent Application No. 2012-012924 filed Jan. 25, 2012.

TECHNICAL FIELD

The present invention relates to a rotary atomizing head type coating machine suitably used for coating a coating object to be coated such as an automobile, home electric appliances and the like, for example.

BACKGROUND ART

In general, when a vehicle body of an automobile, furniture, electric appliances and the like are to be coated, coating is performed by using a rotary atomizing head type coating machine which produces favorable paint coating efficiency and coating finish. This rotary atomizing head type coating machine is provided with a cylindrical housing having a motor accommodating portion, a cylindrical cover covering an outer peripheral side of the housing, an air motor rotating and driving a rotational shaft accommodated in the motor accommodating portion of the housing and supported by an air bearing by a turbine, a rotary atomizing head located on the front side of the housing and mounted on a distal end portion of the rotational shaft of the air motor and spraying a paint supplied while rotating together with the rotational shaft, a feed tube provided by being inserted through the rotational shaft and supplying the paint toward the rotary atomizing head, and a shaping air ring provided by surrounding an outer peripheral surface of the rotary atomizing head on the front end side of the housing and having an air ejection port for ejecting shaping air for shaping a spraying pattern of the paint sprayed from the rotary atomizing head.

In the housing of the rotary atomizing head type coating machine, a bearing air passage through which bearing air flows toward the air bearing of the air motor and a turbine air passage through which turbine air flows toward the turbine of the air motor are provided. Compressed air as the bearing air and the turbine air supplied to these air passages is discharged to the outside of the housing. Here, clean and fully dried dry air is used for the bearing air and the turbine air, and they are supplied at a predetermined pressure and flow rate.

On the other hand, the rotary atomizing head type coating machines include an electrostatic coating machine provided with a high-voltage generator for applying a high voltage to a paint supplied to the rotary atomizing head. In this case, paint particles charged to the high voltage can fly along an electric force line formed between the rotary atomizing head and the coating object to be coated and can coat the coating object to be coated efficiently.

In the recent rotary atomizing head type coating machine, a rotation speed of the rotary atomizing head, that is, the rotation speed of the turbine of the air motor has been raised so that a wide coating range can be efficiently coated by spraying a large quantity of paint. With this trend, the compressed air which becomes the turbine air to be supplied to the air motor has its pressure raised and the flow rate also increased.

As described above, in case the pressure of the turbine air is raised, when the high-pressure turbine air is ejected toward the turbine, the temperature of the high-pressure turbine air rapidly drops due to an action of adiabatic expansion. By means of this temperature drop, the air motor and the housing located on its outer peripheral side and the like are cooled.

Here, in a coating booth in which a coating work is performed, a temperature and humidity are controlled for favorable coating finish. For example, in a booth in which a body of an automobile is to be coated, the temperature is held at approximately 20 to 25° C., and the humidity is held at approximately 70 to 90%. Therefore, if the housing is cooled by the discharged air, condensation occurs on the surface of the cover covering the housing in the high-temperature high-humidity booth.

In the case of the electrostatic coating machine, in case condensation occurs on the surface of the cover, the high voltage to be applied to the paint leaks to the earth side, and electrostatic coating cannot be performed. Moreover, in case the cover is connected to the earth side by the condensation, the paint particles charged to the high voltage fly to the cover side and adheres to the cover surface, which becomes a factor for promoting drop of electric insulating property on the cover surface.

Moreover, not only in the case of the electrostatic coating machine but also in the case of non-electrostatic coating machine, if condensation on the cover surface progresses, the condensed moisture becomes drops of water. If the coating machine is operated in this state, the drops of water on the cover surface diffuse and adhere to the coated surface. In this case, even the drops of water in a mist state with small grain diameters remarkably deteriorate the coating quality in case they adhere to the coated surface regardless of the quantity of the drops of water.

Thus, the rotary atomizing head type coating machine for preventing condensation on the cover surface is used. This coating machine has a space portion so as to surround the periphery of the air motor and is configured such that heat insulating air is made to flow through this space portion. The heat insulating air is configured to be supplied to the space portion from an exclusively provided heat insulating air passage (See, Patent Document 1, for example).

PRIOR ART DOCUMENTS

Patent Documents

Patent Document 1: International Publication No. WO2006/129407 A1

SUMMARY OF THE INVENTION

In the rotary atomizing head type coating machine according to Patent Document 1, exclusive air, that is, compressed air exclusively drawn from an air pressure source is supplied to the space portion as the heat insulating air. Thus, in the coating machine, a passage and piping for the heat insulating air should be provided separately from passages and piping through which the paint, bearing air, turbine air, shaping air and the like flow. As a result, there is a problem that paths of the passages and piping become complicated, and the size of the coating machine increases.

In view of the above-discussed problems with the conventional art, it is an object of the present invention to provide a rotary atomizing head type coating machine which can prevent condensation on the cover surface with a simple configuration and can reduce the entire size by using a part of air communicating through the existing air passage.

(1) A rotary atomizing head type coating machine according to the present invention comprises: a cylindrical housing whose inner peripheral side is a motor accommodating portion; a cylindrical cover covering an outer peripheral side of the housing; an air motor accommodated in the motor accommodating portion of the housing and rotating and driving a rotational shaft supported by an air bearing by a turbine; a rotary atomizing head located on the front side of the housing and mounted on a distal end portion of the rotational shaft of the air motor and spraying a paint supplied while rotating together with the rotational shaft; a feed tube provided by being inserted through the rotational shaft and supplying the paint toward the rotary atomizing head; a shaping air ring provided by surrounding an outer peripheral surface of the rotary atomizing head on the front end side of the housing and having an air ejection port for ejecting shaping air for shaping a spraying pattern of the paint sprayed from the rotary atomizing head; a bearing air passage provided on the housing and supplying bearing air toward the air bearing of the air motor; and a turbine air passage provided on the housing and supplying driving air toward the turbine of the air motor.

In order to solve the above problems, the configuration adopted by the present invention is characterized in that an annular space surrounding the air motor is provided between the housing and the cover; and a part of compressed air supplied from the bearing air passage and/or the turbine air passage toward the air motor is led into the annular space.

With this arrangement, by supplying the bearing air to the air bearing of the air motor through the bearing air passage and by supplying the driving air to the turbine through the turbine air passage, the rotary atomizing head can be rotated and driven together with the rotational shaft. By supplying the paint to the rotary atomizing head through the feed tube in this state, the paint can be sprayed toward a coating object to be coated from the rotary atomizing head. On the other hand, the compressed air supplied to the air bearing and the turbine causes temperature drop by adiabatic expansion when being ejected to the air bearing and the turbine and cools the air motor.

In response to that, the periphery of the air motor is configured such that the annular space is provided at a position surrounding this air motor and a part of the compressed air supplied toward the air motor through the bearing air passage and/or the turbine air passage is led into the annular space. As a result, since the compressed air heated by compression heat can be made to flow through the annular space, the cover covering the outside of the air motor can be kept in a heated state, that is, the cover can be kept in a state in which cooling thereof is prevented.

Therefore, since the cover can be kept in the heated state by making the compressed air flow through the annular space, condensation on the cover surface can be prevented, defective coating caused by adhesion of drops of water can be suppressed, and the coating quality can be kept favorable. On the other hand, if a coating machine is applied to an electrostatic coating machine in which a high voltage is applied, for example, a situation that the high voltage leaks to the cover due to condensation can be prevented, and coating efficiency can be improved. Moreover, adhesion of the paint on the cover surface can be prevented.

As a result, since condensation of the cover can be prevented by a simple configuration in which the compressed air communicating through the existing air passages is led into the annular space surrounding the air motor, an arrangement relationship among the air passages can be made compact, and the size of the entire coating machine can be reduced.

(2) According to the present invention, in the housing, an air branch passage for connecting the bearing air passage and the annular space to each other and/or the turbine air passage and the annular space to each other and for leading a part of the compressed air into the annular space is provided.

With this arrangement, only by providing the air branch passage connecting the bearing air passage and the annular space to each other and/or the turbine air passage and the annular space to each other, the compressed air in the heated state can be led into the annular space. As a result, since the positions and the shapes of the existing bearing air passage and the turbine air passage do not have to be changed, condensation on the cover surface can be prevented by a simple configuration.

(3) According to the present invention, the air branch passage is formed having a narrower diameter as compared with each of the air passages so that a small amount of air which does not affect an operation of the air bearing by the bearing air and an operation of the turbine by the turbine air is led into the annular space. As a result, the air bearing can stably support the rotational shaft. The turbine can stably drive the rotational shaft at a predetermined rotation speed.

(4) According to the present invention, an outflow air flowing out of the annular space is discharged into the atmospheric air at a position of the outer peripheral surface of the rotary atomizing head. As a result, the periphery of the outer peripheral surface of the rotary atomizing head can be brought into a positive pressure state by using the outflow air, and adhesion of the sprayed paint to the outer peripheral surface of the rotary atomizing head can be prevented.

(5) According to the present invention, the shaping air ring is configured such that a jig insertion hole into which a rod of a rotation-stopping jig for regulating rotation of the rotational shaft is inserted is provided extending in a radial direction; an opening on the outer diameter side of the jig insertion hole is opened on a downstream end of the annular space; and an opening on the inner diameter side of the jig insertion hole is opened in an atomizing head accommodating hole of the shaping air ring surrounding the outer peripheral surface of the rotary atomizing head.

With this arrangement, by inserting the rod of the rotation-stopping jig into the jig insertion hole of the shaping air ring, rotation of the rotational shaft can be regulated. In this fixed state of the rotational shaft, the rotary atomizing head can be rotated with respect to the rotational shaft, and the rotary atomizing head can be mounted on/removed from the rotational shaft.

On the other hand, the outflow air flowing out of the annular space can be made to flow out to the atomizing head accommodating hole of the shaping air ring through the jig insertion hole of the shaping air ring. As a result, the periphery of the outer peripheral surface of the rotary atomizing head can be brought into the positive pressure state by using the outflow air, and adhesion of the sprayed paint to the outer peripheral surface of the rotary atomizing head can be prevented.

(6) According to the present invention, the housing is composed of a rear housing part supporting the base end side of the feed tube and having an inlet port of each of the air passages and a front housing part provided on the front side of the rear housing part and on which the motor accommodating portion is provided; the cover is arranged at a position covering the outer peripheral side of the front housing part; and the annular space is formed between the front housing part and the cover.

With this arrangement, the base end side of the feed tube can be supported by the rear housing part of the housing. The compressed air can be supplied to the bearing air passage and the turbine air passage through the inlet port provided on the rear housing part. Moreover, since the cover is configured to be provided on the outer peripheral side of the front housing part, the annular space can be easily formed between this front housing part and the cover. Only by supplying the compressed air into this annular space, the surface of the cover can be kept in the heated state.

(7) According to the present invention, the annular space is provided in a range of an axial length corresponding to the motor accommodating portion of the housing. As a result, since the annular space can be provided at a position surrounding this air motor over the entire length in the periphery of the air motor, transmission of cold air from the air motor to the cover can be reliably prevented.

MODE FOR CARRYING OUT THE INVENTION

A rotary atomizing head type coating machine according to embodiments of the present invention will be described below in detail according to the attached drawings. Here, the rotary atomizing head type coating machines include an electrostatic coating machine for coating by applying a high voltage and a non-electrostatic coating machine for coating without applying a high voltage, but the embodiments which will be described below describe a direct charging type electrostatic coating machine as an example.

FIGS. 1 to 8 illustrate a first embodiment of the rotary atomizing head type coating machine according to the present invention.

Figure 1:
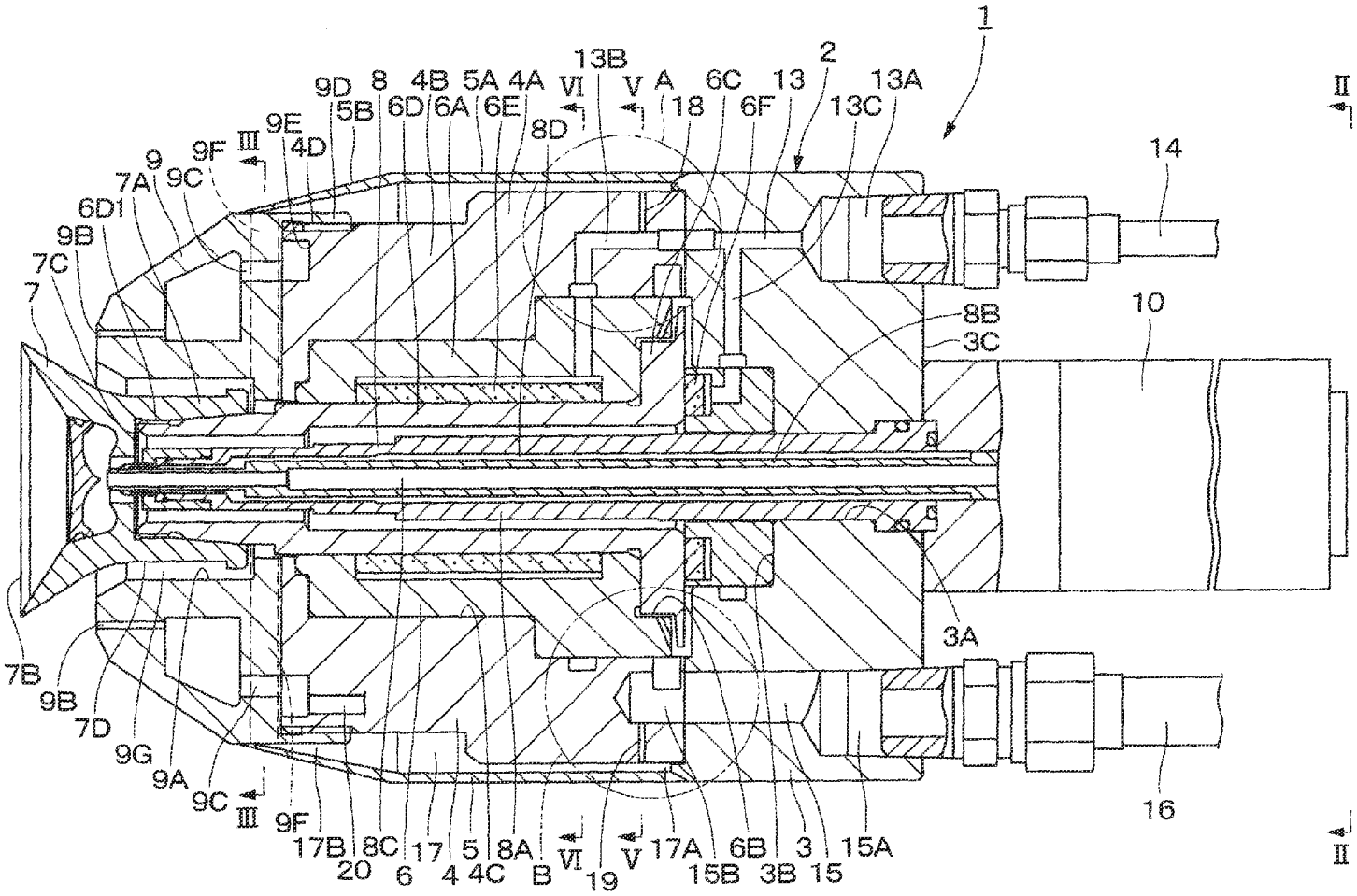
FIG. 1 is a longitudinal sectional view of a rotary atomizing head type coating machine according to a first embodiment of the present invention when seen from an arrow I-I direction in FIG. 2.
Figure 2:
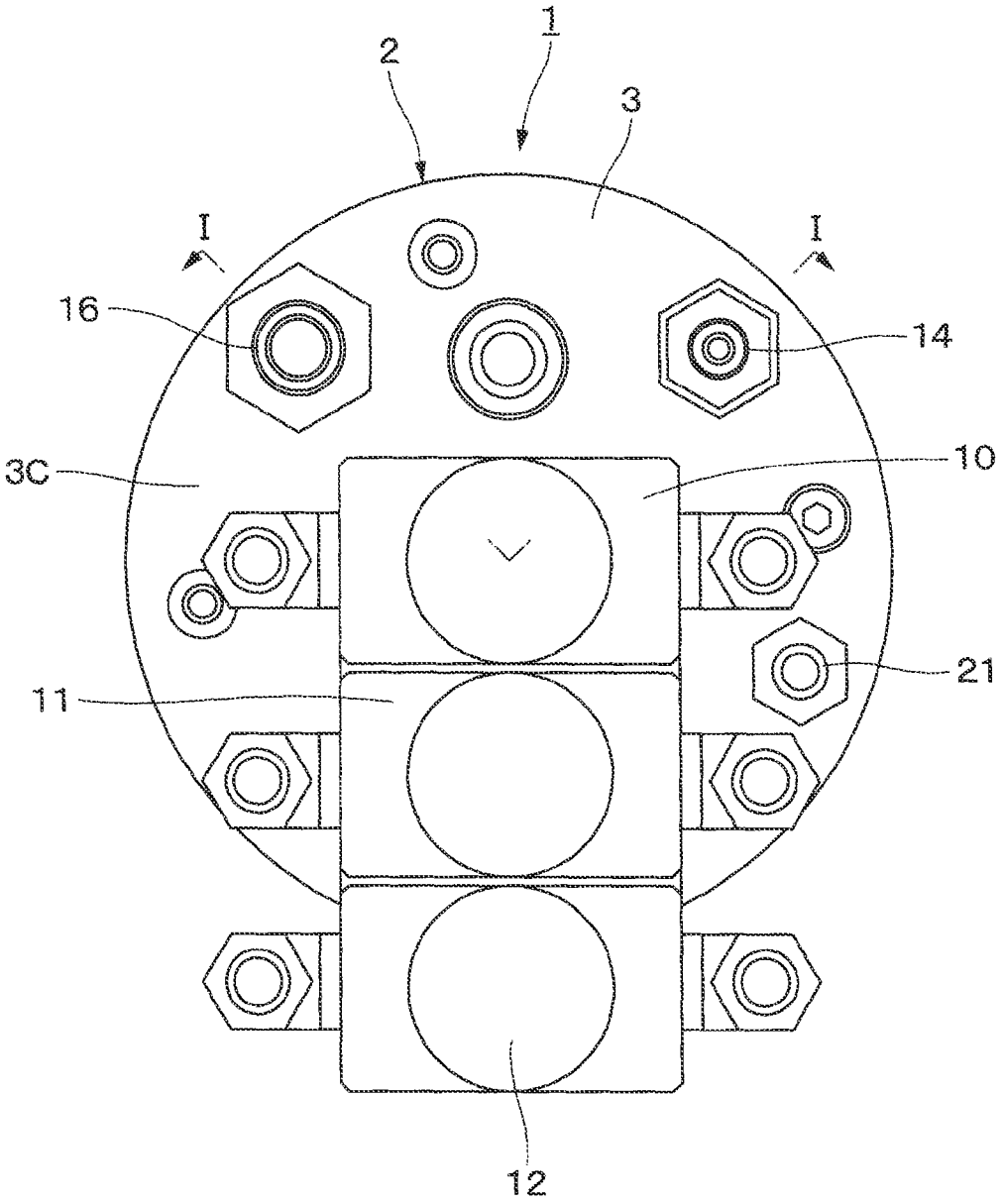
FIG. 2 is a rear view of the rotary atomizing head type coating machine in FIG. 1 when seen from an arrow II-II direction.

In FIG. 1, designated at 1 is a rotary atomizing head type coating machine according to the first embodiment. This rotary atomizing head type coating machine 1 is configured as a direct charging type electrostatic coating machine which directly applies a high voltage to a paint by a high-voltage generator (not shown). The rotary atomizing head type coating machine 1 is mounted on a distal end of an arm (not shown) of a coating robot, a reciprocator and the like, for example. The rotary atomizing head type coating machine 1 is composed of a housing 2, a cover 5, an air motor 6, a rotary atomizing head 7, a feed tube 8, a shaping air ring 9, a bearing air passage 13, a turbine air passage 15, an annular space 17, a bearing air branch passage 18, a turbine air branch passage 19 and the like, which will be described later.

Designated at 2 is the housing of the rotary atomizing head type coating machine 1. This housing 2 is composed of a rear housing part 3 which is located on the rear side in the axial direction and will be described later and a front housing part 4 provided on the front side of the rear housing part 3. The housing 2 accommodates the air motor 6 therein.

The rear housing part 3 constitutes a rear-side portion of the housing 2, and the rear housing part 3 is mounted on a distal end of the arm of the coating robot, for example. In this case, the rear housing part 3 is formed by using a resin material having insulating property such as highly functional resin materials (engineering plastic) including polytetrafluoroethylene (PTFE), polyetheretherketone (PEEK), polyetherimide (PEI), polyoxymethylene (POM), polyimide (PI), polyethylene terephthalate (PET) and the like. As a result, the rear housing part 3 insulates a space between the air motor 6 charged at a high voltage by the high-voltage generator and the arm of the coating robot by being formed using the insulating resin material along with the front housing part 4 and the cover 5 which will be described later and prevents leakage of the high voltage applied to the paint to the earth side.

The rear housing part 3 is formed as a cylindrical body which is thick in the radial direction, and the shaft center position of the rear housing part 3 is a tube support hole 3A supporting the base end side of the feed tube 8 which will be described later. The front part side of this tube support hole 3A becomes a thrust bearing accommodating portion 3B by expanding, and a thrust air bearing 6F of the air motor 6 which will be described later is accommodated in the thrust bearing accommodating portion 3B. On the other hand, on the side of a rear end surface 3C of the rear housing part 3, a trigger valve 10, a damp valve 11, a distal end wash valve 12 which will be described later are mounted in a state juxtaposed in the vertical direction, for example. Moreover, on the rear end surface 3C of the rear housing part 3, an inlet port 13A of the bearing air passage 13, an inlet port 15A of the turbine air passage 15, and an inlet port (not shown) of a shaping air passage 20 which will be described later and the like are opened.

The front housing part 4 is mounted on the front side of the rear housing part 3, and the front housing part 4 is formed by using an insulating resin material substantially similar to the rear housing part 3, for example. The front housing part 4 is formed as a stepped cylindrical body in which the rear side is a large-diameter tubular portion 4A and the front side is a small-diameter tubular portion 4B. The inner peripheral side of the front housing part 4 becomes a stepped motor accommodating portion 4C whose diameter is getting smaller in a stepped manner toward the front side, and a motor case 6A of the air motor 6 which will be described later is inserted into and fitted with this motor accommodating portion 4C. On the outer peripheral side of the small-diameter tubular portion 4B, a male screw portion 4D is formed by being located on the front part side. Moreover, on the front housing part 4, the bearing air passage 13, the turbine air passage 15, the bearing air branch passage 18, the turbine air branch passage 19, the shaping air passage 20 and the like which will be described later are provided.

The cover 5 is mounted on the outer peripheral side of the front housing part 4 so as to cover the front housing part 4. This cover 5 is formed of an insulating resin material substantially similar to the rear housing part 3 and the front housing part 4, for example, and is formed as a cylindrical body having a smooth outer peripheral surface 5A which becomes the surface. The front side of the cover 5 is a tapered portion 5B whose diameter is reduced toward the front, and the tapered portion 5B covers a mounting tubular portion 9D of the shaping air ring 9, which will be described later, on the front side portion thereof. Here, the cover 5 can form the cylindrical annular space 17 which will be described later between the inner peripheral surface of the cover 5 and the outer peripheral surface of the front housing part 4 by being fixed to the outer peripheral side of the front housing part 4.

The air motor 6 is provided on the housing 2, and the air motor 6 rotates the rotary atomizing head 7 which will be described later using compressed air as a power source at a high speed of 3000 to 150000 rpm, for example. The air motor 6 is composed of the stepped cylindrical motor case 6A accommodated in the motor accommodating portion 4C of the front housing part 4, a turbine 6C located closer to the rear side of the motor case 6A and rotatably accommodated in a turbine chamber 6B, a hollow rotational shaft 6D having the base end side in the axial direction is integrally mounted on the center part of the turbine 6C and a distal end portion extending to the front side protruding from the motor case 6A, and a radial air bearing 6E provided on the motor case 6A and rotatably supporting the rotational shaft 6D. On the other hand, in the thrust bearing accommodating portion 3B of the rear housing part 3, the thrust air bearing 6F constituting a part of the air motor 6 is provided.

Here, the motor case 6A, the rotational shaft 6D and the like are formed by using a metal material having conductivity such as an aluminum alloy and the like, for example. As a result, by electrically connecting a high-voltage generator to the motor case 6A, a high voltage can be applied to the paint supplied toward the rotary atomizing head 7 through the rotational shaft 6D.

The rotational shaft 6D of the air motor 6 has its distal end portion protruding into an atomizing head accommodating hole 9A of the shaping air ring 9 which will be described later, and a male screw portion 6D1 is formed on the outer peripheral side of the distal end portion. This male screw portion 6D1 is screwed with a female screw portion 7C of the rotary atomizing head 7.

Figure 3:
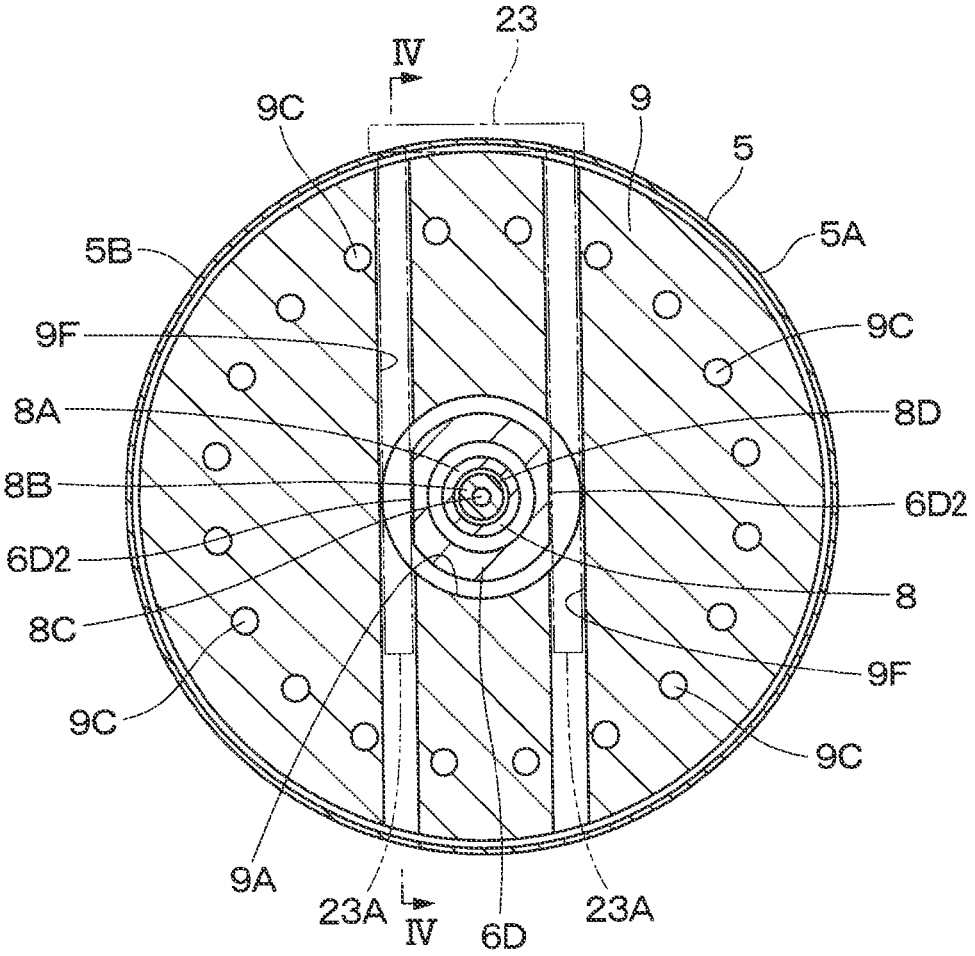
FIG. 3 is a cross sectional view of the rotary atomizing head type coating machine when seen from an arrow III-III direction in FIG. 1.

Moreover, as illustrated in FIG. 3, on the distal end side of the rotational shaft 6D, a pair of notched surface portions 6D2 in parallel with each other are formed at axial positions corresponding to jig insertion holes 9F of the shaping air ring 9. When a rod 23A of a rotation-stopping jig 23 which will be described later is inserted through each of the jig insertion holes 9F of the shaping air ring 9, each of the notched surface portions 6D2 is engaged with the rod 23A and regulates (stops) rotation of the rotational shaft 6D. In this stopped state of the rotational shaft 6D, the rotary atomizing head 7 can be rotated with respect to the rotational shaft 6D, and the rotary atomizing head 7 can be mounted on or removed from the rotational shaft 6D.

The air motor 6 configured as above supplies compressed air to the radial air bearing 6E and the thrust air bearing 6F through the bearing air passage 13 which will be described later. In this case, the radial air bearing 6E forms an air layer between that and the outer peripheral surface of the rotational shaft 6D and can rotatably support the rotational shaft 6D. On the other hand, the thrust air bearing 6F is faced with a rear end surface of the turbine 6C while forming an air layer between itself and the rear end surface, whereby the rotational shaft 6D can be positioned in the axial direction while allowing rotation of the rotational shaft 6D.

Here, the radial air bearing 6E stably forms an air layer between itself and the rotational shaft 6D and the thrust air bearing 6F stably forms an air layer between itself and the turbine 6C. Thus, compressed air with a certain pressure is supplied at a certain flow rate to each of the air bearings 6E and 6F.

The air motor 6 supplies the compressed air to the turbine 6C through the turbine air passage 15 which will be described later. In this case, by adjusting the pressure and flow rate of the compressed air to be supplied to the turbine 6C, a rotation speed of the turbine 6C (rotational shaft 6D) can be adjusted. In general, the compressed air supplied to the turbine 6C has a pressure higher and a flow rate larger than those of the compressed air to be supplied to each of the air bearings 6E and 6F.

The rotary atomizing head 7 is mounted on the distal end portion of the rotational shaft 6D of the air motor 6, and this rotary atomizing head 7 is formed having a bell shape or a cup shape, for example. Specifically, in the rotary atomizing head 7, the base end side becomes a cylindrical mounting portion 7A, and the distal end side is expanded and becomes a paint spraying portion 7B. In the depth of the mounting portion 7A, the female screw portion 7C screwed with the male screw portion 6D1 of the rotational shaft 6D is formed. Moreover, an outer peripheral surface 7D of the rotary atomizing head 7 is expanded in a tapered manner toward the paint spraying portion 7B. The rotary atomizing head 7 sprays the paint as a large number of paint particles made into particulates by a centrifugal force from the paint spraying portion 7B when the paint is supplied from the feed tube 8 which will be described later in a state rotated at a high speed by the air motor 6.

Here, the outer peripheral surface 7D of the rotary atomizing head 7 spreads over a range from the mounting portion 7A to the paint spraying portion 7B. In general, in case the rotary atomizing head 7 is rotated at a high speed, a negative pressure is generated on the outer peripheral surface 7D side of the rotary atomizing head 7 by the centrifugal force. In response to that, in the first embodiment, the compressed air flowing out of the annular space 17 is discharged to the atomizing head accommodating hole 9A of the shaping air ring 9, whereby an annular air discharge passage 9G located in the periphery of the outer peripheral surface 7D of the rotary atomizing head 7 can be brought into a positive pressure state by discharged air.

The feed tube 8 is provided by being inserted into the rotational shaft 6D of the air motor 6, and the base end side of the feed tube 8 is fixed to the tube support hole 3A of the rear housing part 3 in an inserted state. On the other hand, the distal end side of the feed tube 8 extends into the rotary atomizing head 7 by protruding from the distal end of the rotational shaft 6D. The feed tube 8 is formed as a tubular body having a double structure of an outer tube 8A and an inner tube 8B, and a passage in the inner tube 8B is a paint passage 8C. An annular passage between the outer tube 8A and the inner tube 8B is a wash fluid passage 8D. The paint passage 8C is connected to a paint supply source such as a color changing valve device and the like, and the wash fluid passage 8D is connected to a wash fluid supply source (neither of them is shown).

The feed tube 8 supplies the paint toward the rotary atomizing head 7 from the paint passage 8C when a trigger valve 10 which will be described later is opened. On the other hand, the feed tube 8 can supply a wash fluid toward the rotary atomizing head 7 from the wash fluid passage 8D when the distal end wash valve 12 which will be described later is opened.

The shaping air ring 9 is provided on the front side of the front housing part 4 of the housing 2. This shaping air ring 9 is formed as a cylindrical body using an insulating resin material similar to the housing 2. The shaping air ring 9 is mounted coaxially on a front side position of the front housing part 4, and at the axial center position of the shaping air ring 9, the atomizing head accommodating hole 9A through which the mounting portion 7A of the rotary atomizing head 7 and the rotational shaft 6D of the air motor 6 are inserted is formed. On the front part of the shaping air ring 9, a large number of air ejection ports 9B (only two of them are shown) are opened by being juxtaposed in the circumferential direction so as to surround the rotary atomizing head 7. Each of the air ejection ports 9B is connected to the shaping air passage 20 which will be described later through a plurality of communication holes 9C and the upstream side thereof is connected to an air pressure source through a shaping air supply hose 21.

The shaping air ring 9 ejects shaping air supplied through the shaping air supply hose 21 and the shaping air passage 20 from each of the air ejection ports 9B. As a result, a spraying pattern of the paint sprayed from the rotary atomizing head 7 is shaped to a desired spraying pattern by the shaping air.

On the outer peripheral side on the rear part of the shaping air ring 9, the mounting tubular portion 9D extends rearward. On the inner peripheral side of this mounting tubular portion 9D, a female screw portion 9E screwed with the male screw portion 4D of the front housing part 4 is formed.

As illustrated in FIG. 3, on the rear part side of the shaping air ring 9, the two jig insertion holes 9F are provided by being juxtaposed in parallel and extending in the radial direction so that they can pass through the atomizing head accommodating hole 9A. As indicated by a two-dot chain line in FIG. 3, through these two jig insertion holes 9F, the rod 23A of the rotation-stopping jig 23 which will be described later can be inserted. In this case, each of the jig insertion holes 9F is formed by penetrating through the atomizing head accommodating hole 9A of the shaping air ring 9 in the radial direction. Therefore, regarding each of the jig insertion holes 9F, an opening on the outer diameter side is opened in a downstream end 17B of the annular space 17, while an opening on the inner diameter side is opened in the atomizing head accommodating hole 9A, whereby the annular space 17 and the inside of the atomizing head accommodating hole 9A communicate with each other.

Figure 4:
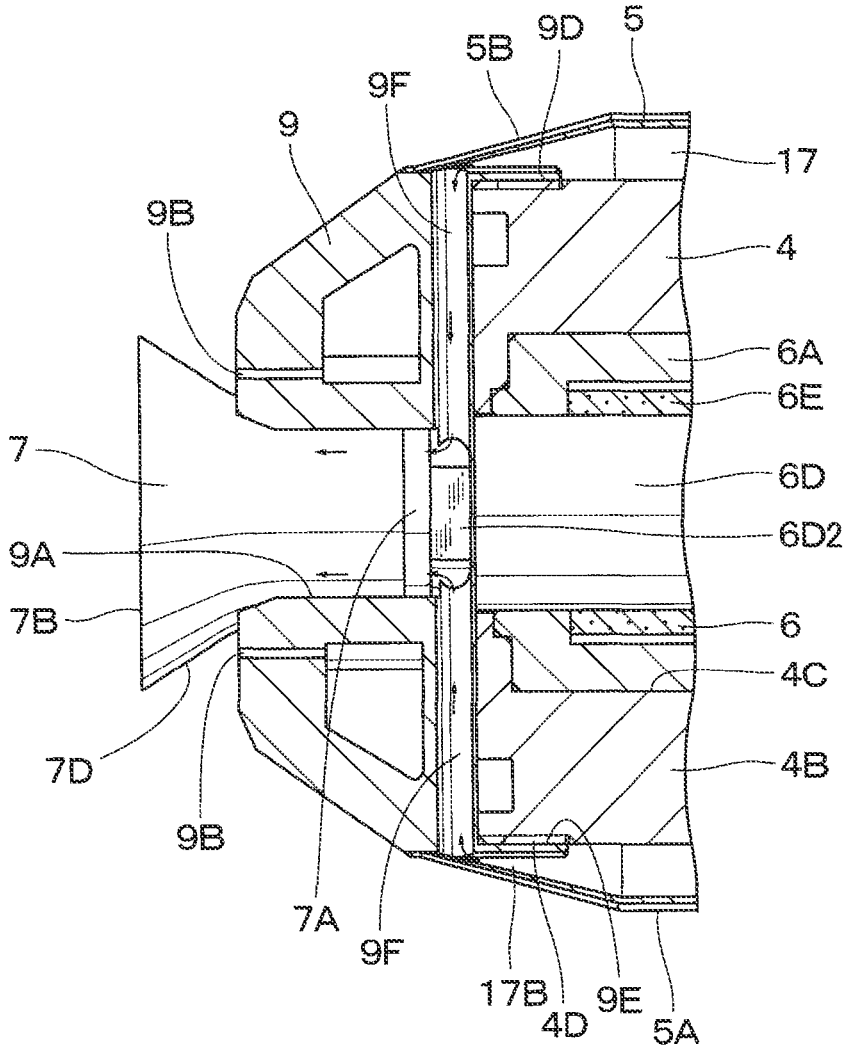
FIG. 4 is a longitudinal sectional view of the rotary atomizing head type coating machine when seen from an arrow IV-IV direction in FIG. 3.

Moreover, in the inner diameter side of the atomizing head accommodating hole 9A, that is, between the outer peripheral surface 7D of the rotary atomizing head 7 and the atomizing head accommodating hole 9A, the annular air discharge passage 9G is formed. As a result, as illustrated in FIG. 4, each of the jig insertion holes 9F can discharge the compressed air flowing out from the annular space 17 to the outside through the annular air discharge passage 9G in the atomizing head accommodating hole 9A.

The trigger valve 10 is mounted on the rear housing part 3 of the housing 2, and the trigger valve 10 supplies/stops the paint or the wash fluid supplied to the paint passage 8C of the feed tube 8. The damp valve 11 is mounted on the rear housing part 3 of the housing 2 so as to overlap the trigger valve 10 (See, FIG. 2). This damp valve 11 discharges the previous color paint from a paint supply passage by opening the valve when the color of the paint is to be changed. Moreover, the distal end wash valve 12 is mounted on the rear housing part 3 of the housing 2 so as to overlap with the damp valve 11. This distal end wash valve 12 supplies/stops the wash fluid to the wash fluid passage 8D of the feed tube 8 by opening/closing.

Subsequently, the bearing air passage 13, the turbine air passage 15, and the annular space 17 which constitute an essential part of the first embodiment will be described.

Designated at 13 is the bearing air passage provided on the housing 2. This bearing air passage 13 supplies the compressed air toward the radial air bearing 6E and the thrust air bearing 6F constituting the air motor 6 and is connected to an air pressure source (not shown) such as a compressor or the like. The bearing air passage 13 is formed over the rear housing part 3, the front housing part 4, and the motor case 6A of the air motor 6.

The bearing air passage 13 is composed of the inlet port 13A provided by being opened on the rear end surface 3C of the rear housing part 3 and to which a bearing air supply hose 14 is connected, a first passage portion 13B extending from the inlet port 13A to the front side up to the front housing part 4 through the rear housing part 3 and bent inward in the radial direction and connected to the radial air bearing 6E, and a second passage portion 13C branching from the first passage portion 13B on the rear housing part 3 and connected to the thrust air bearing 6F.

Here, the compressed air to be supplied to each of the air bearings 6E and 6F of the air motor 6 from the bearing air passage 13 will be described. Each of the air bearings 6E and 6F supports the rotational shaft 6D in a state floated with a static pressure through an air layer by ejecting the compressed air between them and the rotational shaft 6D. Therefore, the compressed air supplied to each of the air bearings 6E and 6F is supplied with a low pressure and in a constant quantity as compared with the compressed air for driving the turbine 6C.

Designated at 15 is a turbine air passage provided on the housing 2. This turbine air passage 15 supplies the compressed air toward the turbine 6C constituting the air motor 6 and is connected to the air pressure source. The turbine air passage 15 is formed over the rear housing part 3, the front housing part 4, and the air motor 6 substantially similarly to the bearing air passage 13. That is, the turbine air passage 15 is provided by being opened on the rear end surface 3C of the rear housing part 3 and is composed of the inlet port 15A to which a turbine air supply hose 16 is connected and a passage portion 15B extending from the inlet port 15A to the front housing part 4 on the front side through the rear housing part 3, bent inward in the radial direction and connected to the outer peripheral side of the turbine chamber 6B.

The compressed air supplied from the turbine air passage 15 to the turbine 6C of the air motor 6 will be described. Since the turbine 6C rotates and drives the rotational shaft 6D at a high speed, the compressed air is supplied thereto at a high pressure and in a large quantity as compared with the compressed air supplied to each of the air bearings 6E and 6F. As an example thereof, high pressure turbine air with a flow rate of 100 to 700 NL/min is supplied in a large quantity at a pressure of 0.1 to 0.9 MPa from the turbine air passage 15 to the turbine chamber 6B of the air motor 6. In this case, the air motor 6 can rotate the turbine 6C at a high speed by ejecting the turbine air at a high pressure and a large flow rate. On the other hand, since the turbine air is subjected to adiabatic expansion when being ejected to the turbine chamber 6B, the temperature of the turbine air at this time rapidly drops.

Designated at 17 is the annular space provided on the outer peripheral side of the housing 2. This annular space 17 is provided so as to surround the air motor 6 in a range of the axial length corresponding to the motor accommodating portion 4C of the front housing part 4. That is, the annular space 17 is formed between the rear end and the front end of the front housing part 4 over its entire length. Here, the annular space 17 can bring the inside thereof into a heated state by a part of the compressed air supplied to the air bearings 6E and 6F of the air motor 6 and a part of the compressed air supplied to the turbine 6C communicating with each other.

The annular space 17 is described as being formed between the rear end and the front end of the front housing part 4 over its entire length, but the annular space 17 may be formed shorter than the entire length of the front housing part 4. On the other hand, the annular space 17 may be formed longer than the entire length of the front housing part 4.

Figure 5:
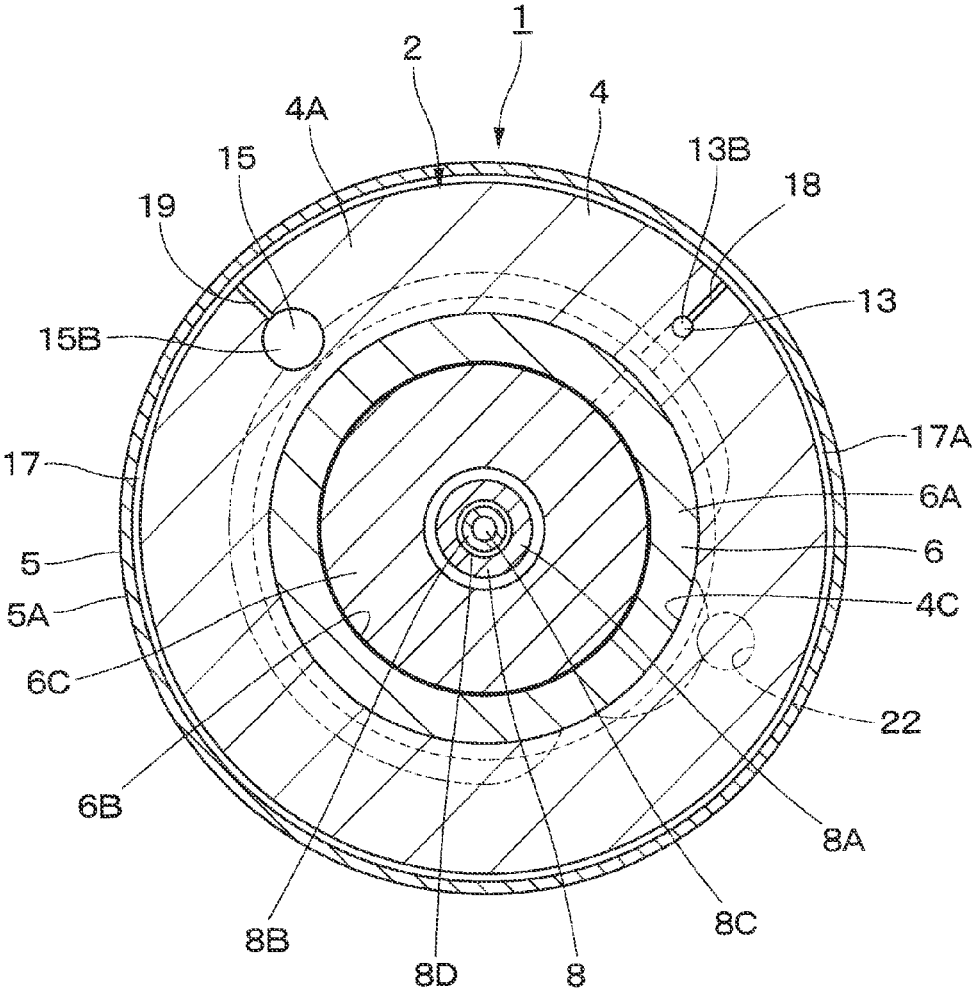
FIG. 5 is a cross sectional view of the rotary atomizing head type coating machine in FIG. 1 when seen from an arrow V-V direction.
Figure 6:
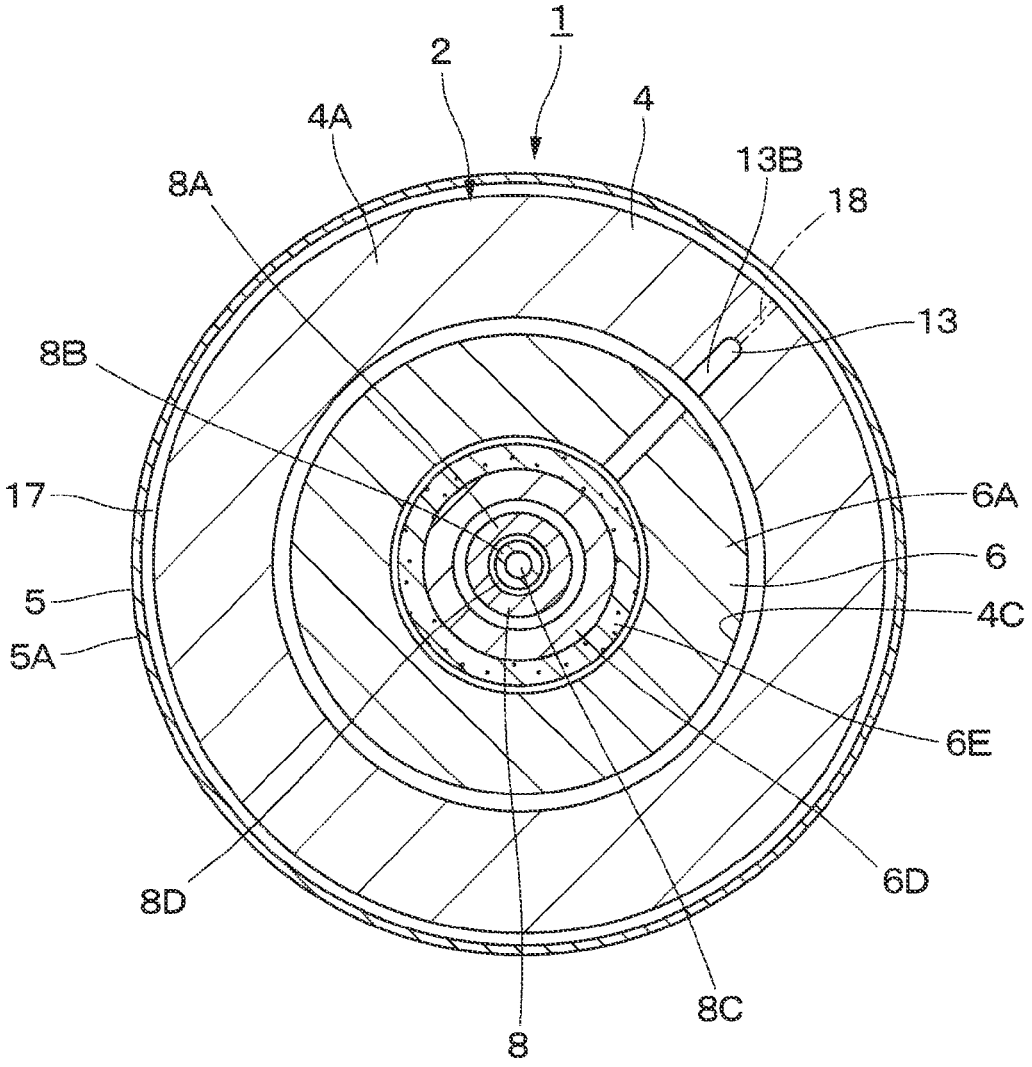
FIG. 6 is a cross sectional view of the rotary atomizing head type coating machine in FIG. 1 when seen from an arrow VI-VI direction.

That is, as illustrated in FIGS. 1, 5, and 6, the annular space 17 is formed as an annular space between the outer peripheral side of the front housing part 4 and the inner peripheral side of the cover 5. Specifically, regarding the annular space 17, a boundary position between the rear housing part 3 and the front housing part 4 becomes an upstream end 17A, and a gap between a distal end of the tapered portion 5B of the cover 5 and the mounting tubular portion 9D of the shaping air ring 9 becomes the downstream end 17B. As illustrated in FIGS. 3 and 4, the downstream end 17B of this annular space 17 communicates with the jig insertion hole 9F of the shaping air ring 9. As a result, as illustrated by an arrow in FIG. 4, the compressed air (outflow air) flowing out of the annular space 17 is led into the atomizing head accommodating hole 9A of the shaping air ring 9 through the jig insertion hole 9F and discharged into the atmospheric air through the annular air discharge passage 9G formed at the position of the outer peripheral surface 7D of the rotary atomizing head 7.

Designated at 18 is the bearing air branch passage provided on the rear side of the front housing part 4. This bearing air branch passage 18 branches from a supply middle position of the bearing air passage 13 and communicates with a position on the upstream end 17A side of the annular space 17 and is formed as a small-diameter hole extending in the radial direction. As a result, the bearing air branch passage 18 can lead a part of the bearing air communicating through the bearing air passage 13 toward the radial air bearing 6E of the air motor 6 to the annular space 17.

Figure 7:
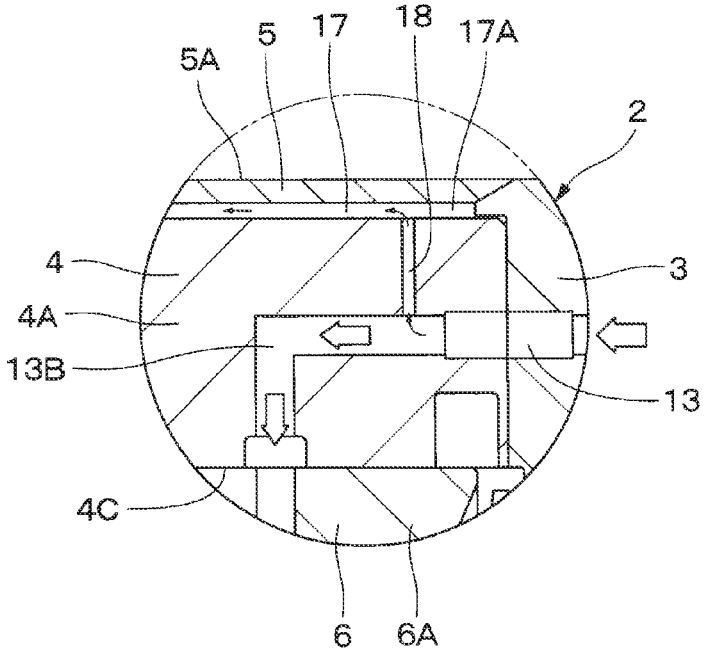
FIG. 7 is an enlarged longitudinal sectional view of an essential part, illustrating an A part in FIG. 1 in an enlarged manner.

Here, as illustrated in FIG. 7, regarding the bearing air branch passage 18, its inner diameter dimension (passage sectional area) is set so that a slight flow rate of the compressed air flows toward the annular space 17. Specifically, the bearing air branch passage 18 is set so that approximately 5 to 10% of the compressed air flows with respect to the total amount of the compressed air flowing through the bearing air passage 13. As a result, the bearing air branch passage 18 is formed having a narrower diameter as compared with the bearing air passage 13, and the compressed air flowing out of the bearing air passage 13 to the annular space 17 side is in a small amount. Therefore, a large amount of the bearing air can be supplied to each of the air bearings 6E and 6F, and the rotational shaft 6D can be stably supported. On the other hand, regarding the annular space 17, only if the compressed air in a state heated by the compression heat flows through the annular space 17 only little by little, cold air caused by the air motor 6 can be shut off, and the cover 5 can be kept in the heated state (that is, the state that can prevent cooling of the cover 5).

Figure 8:
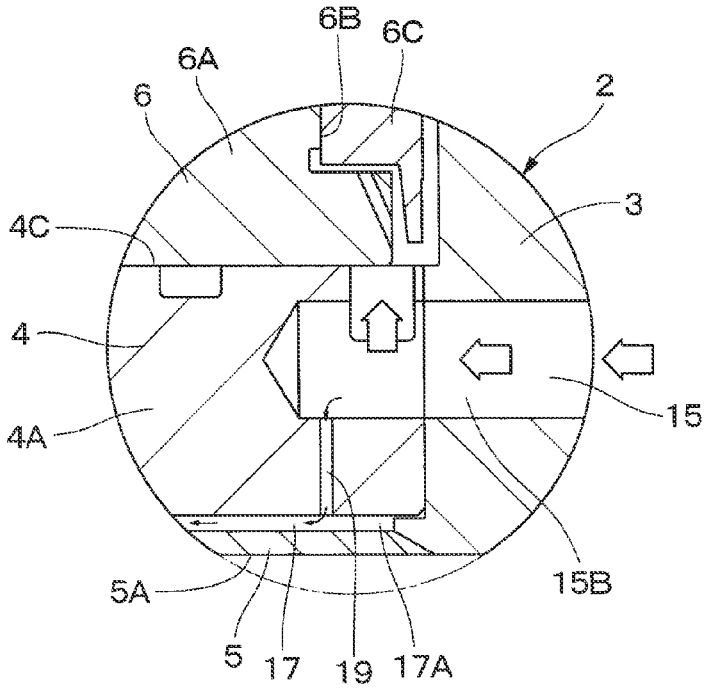
FIG. 8 is an enlarged longitudinal sectional view of an essential part, illustrating a B part in FIG. 1 in an enlarged manner.

Designated at 19 is a turbine air branch passage provided on the rear side of the front housing part 4. As illustrated in FIG. 8, this turbine air branch passage 19 branches from a supply middle position of the turbine air passage 15 substantially similarly to the bearing air branch passage 18 and communicates with a position on the upstream end 17A side of the annular space 17 and is formed as a narrow-diameter hole extending in the radial direction. As a result, the turbine air branch passage 19 can lead a part of the turbine air communicating through the turbine air passage 15 toward the turbine chamber 6B of the air motor 6 to the annular space 17.

The turbine air branch passage 19 is set so that approximately 5 to 10% of the compressed air flows with respect to the total amount of the compressed air following through the turbine air passage 15 substantially similarly to the bearing air branch passage 18. As described above, in the turbine air branch passage 19, only a small amount of the compressed air branching from the turbine air passage 15 is led to the annular space 17. Therefore, since a large amount of the turbine air is supplied to the turbine 6C, the rotational shaft 6D can be stably driven at a predetermined rotation speed. Moreover, in the annular space 17, the cold air caused by the air motor 6 is shut off, and the cover 5 can be kept in the heated state (that is, the state that can prevent cooling of the cover 5).

As illustrated in FIG. 5, the bearing air branch passage 18 and the turbine air branch passage 19 according to the first embodiment are arranged at positions shifted by approximately 90 degrees in the circumferential direction. The arrangement is realized by forming the bearing air branch passage 18 so as to communicate with the existing bearing air passage 13 and by forming the turbine air branch passage 19 so as to communicate with the turbine air passage 15. Therefore, only by drilling a hole in the housing 2, condensation on the outer peripheral surface 5A of the cover 5 can be prevented. Moreover, the bearing air branch passage 18 and the turbine air branch passage 19 have the compressed air flow into the annular space 17 from different two spots and thus, the compressed air can be supplied to every corner in the annular space 17 having a ring shape.

As illustrated in FIG. 1, the shaping air passage 20 is provided on the housing 2, and the shaping air passage 20 is for the compressed air to flow toward each of the air ejection ports 9B of the shaping air ring 9 and is connected to an air pressure source through the shaping air supply hose 21 (See FIG. 2) and the like. On the other hand, as indicated by a two-dot chain line in FIG. 5, designated at 22 is a discharge passage of the turbine air, and the discharge passage 22 is to discharge the compressed air supplied to the turbine chamber 6B to the atmospheric air from the rear side of the housing 2.

Moreover, the rotation-stopping jig 23 is used as a tool for mounting and removing the rotary atomizing head 7 with respect to the rotational shaft 6D (indicated by the two-dot chain line in FIG. 3). This rotation-stopping jig 23 is engaged with each of the notched surface portions 6D2 of the rotational shaft 6D and can regulate rotation of the rotational shaft 6D by inserting the two rods 23A extending in parallel into each of the jig insertion holes 9F of the shaping air ring 9. In a state in which this rotational shaft 6D is fixed, by rotating the rotary atomizing head 7, a work of mounting/removing the rotary atomizing head 7 with respect to the rotational shaft 6D can be performed.

The rotary atomizing head type coating machine 1 according to the first embodiment has the aforementioned configuration, and subsequently, an operation for performing a coating work by using this coating machine 1 will be described.

The bearing air is supplied to the radial air bearing 6E and the thrust air bearing 6F of the air motor 6 through the bearing air passage 13 so as to rotatably support the rotational shaft 6D. On the other hand, the turbine air is supplied to the turbine chamber 6B of the air motor 6 through the turbine air passage 15 so as to rotate and drive the turbine 6C. As a result, the rotary atomizing head 7 is rotated at a high speed together with the rotational shaft 6D. In this state, by supplying the paint selected by the color changing valve device from the paint passage 8C of the feed tube 8 to the rotary atomizing head 7, this paint can be sprayed as paint particles made into particulates from the rotary atomizing head 7.

At this time, since a high voltage has been applied to the paint (paint particles) by the high-voltage generator, the paint particles charged with the high voltage can fly to the coating object to be coated connected to the earth and coat the coating object efficiently.

On the other hand, since the temperature of the high-pressure turbine air supplied to the turbine chamber 6B of the air motor 6 from the turbine air passage 15 drops due to the adiabatic expansion when ejected to the turbine chamber 6B, the air motor 6 is cooled by the temperature drop by this adiabatic expansion.

Here, in the coating booth in which the coating work is performed, the temperature and humidity are kept constant so that the coating finish becomes favorable, and the temperature in the coating booth is kept at approximately 20 to 25° C. and the humidity at approximately at 70 to 90%, for example. Therefore, in case the cover 5 is cooled by the cooled air motor 6 through the housing 2, condensation can easily occur on the outer peripheral surface 5A (surface) of the cover 5 in a high-temperature and high-humidity environment.

On the other hand, according to the first embodiment, in the periphery of the air motor 6, the annular space 17 is configured to be provided at a position surrounding the air motor 6 between the front housing part 4 and the cover 5. Moreover, the bearing air branch passage 18 connecting the annular space 17 and the bearing air passage 13 to each other and the turbine air branch passage 19 connecting the annular space 17 and the turbine air passage 15 to each other are provided in the housing 2. As a result, the air branch passages 18 and 19 can lead a part of the compressed air in the heated state to be supplied toward each of the air bearings 6E and 6F of the air motor 6 and the turbine 6C, respectively, to the annular space 17.

Therefore, by allowing the compressed air to flow through the annular space 17, the periphery of the cover 5 can be kept in a heated state by the compressed air, and even if the air motor 6 is cooled, the temperature drop of the cover 5 can be suppressed. As a result, even in the case of electrostatic coating, leakage of a high voltage to the cover 5 due to condensation can be prevented, and coating efficiency can be improved, and adhesion of the paint to the outer peripheral surface 5A of the cover 5 can be prevented. Moreover, the drops of water generated on the outer peripheral surface 5A of the cover 5 due to condensation can be prevented from adhering to the coated surface and from causing defective coating, and coating quality can be kept favorable.

As a result, with the simple configuration in which the compressed air is allowed to flow through the annular space 17 surrounding the air motor 6 by using the existing air passages 13 and 15, condensation on the outer peripheral surface 5A of the cover 5 can be prevented. Therefore, the arrangement relationship of the bearing air passage 13, the turbine air passage 15 and the like can be made compact, and the size of the rotary atomizing head type coating machine 1 can be reduced.

Moreover, the bearing air branch passage 18 and the turbine air branch passage 19 can be easily formed only by drilling holes in the housing 2. As a result, since there is no need to change the positions and the shapes of the existing bearing air passage 13 and the turbine air passage 15, condensation of the cover 5 can be prevented with the simple configuration.

Since the bearing air branch passage 18 and the turbine air branch passage 19 are formed having the respective passage sectional areas smaller than the bearing air passage 13 and the turbine air passage 15, a small amount of air that does not affect the operations of the air bearings 6E and 6F by the bearing air and the operation of the turbine 6C by the turbine air can be led to the annular space 17. As a result, the air bearings 6E and 6F can stably support the rotational shaft 6D. The turbine 6C can stably drive the rotational shaft 6D at a predetermined rotation speed.

On the other hand, the outflow air flowing out of the annular space 17 can be made to flow out to the atomizing head accommodating hole 9A by using each of the jig insertion holes 9F of the shaping air ring 9 and can be discharged to the outside through the annular air discharge passage 9G provided between this atomizing head accommodating hole 9A and the outer peripheral surface 7D of the rotary atomizing head 7. Therefore, even if the rotary atomizing head 7 rotates at a high speed, the periphery of the outer peripheral surface 7D of the rotary atomizing head 7 can be brought into the positive pressure state by using the outflow air from the annular space 17, and adhesion of the sprayed paint to the outer peripheral surface 7D of the rotary atomizing head 7 can be prevented.

Since the annular space 17 is configured to be provided between the outer peripheral side of the front housing part 4 and the inner peripheral side of the cover 5, the annular space 17 can be easily formed between the front housing part 4 and the cover 5. Only by supplying the compressed air to this annular space 17, condensation of the outer peripheral surface 5A of the cover 5 can be prevented.

Moreover, since the annular space 17 is provided in a range of the axial length corresponding to the motor accommodating portion 4C of the front housing part 4, the periphery of the air motor 6 can be covered by the annular space 17. As a result, transmission of the cold air caused by the air motor 6 to the cover 5 can be reliably prevented.

Figure 9:
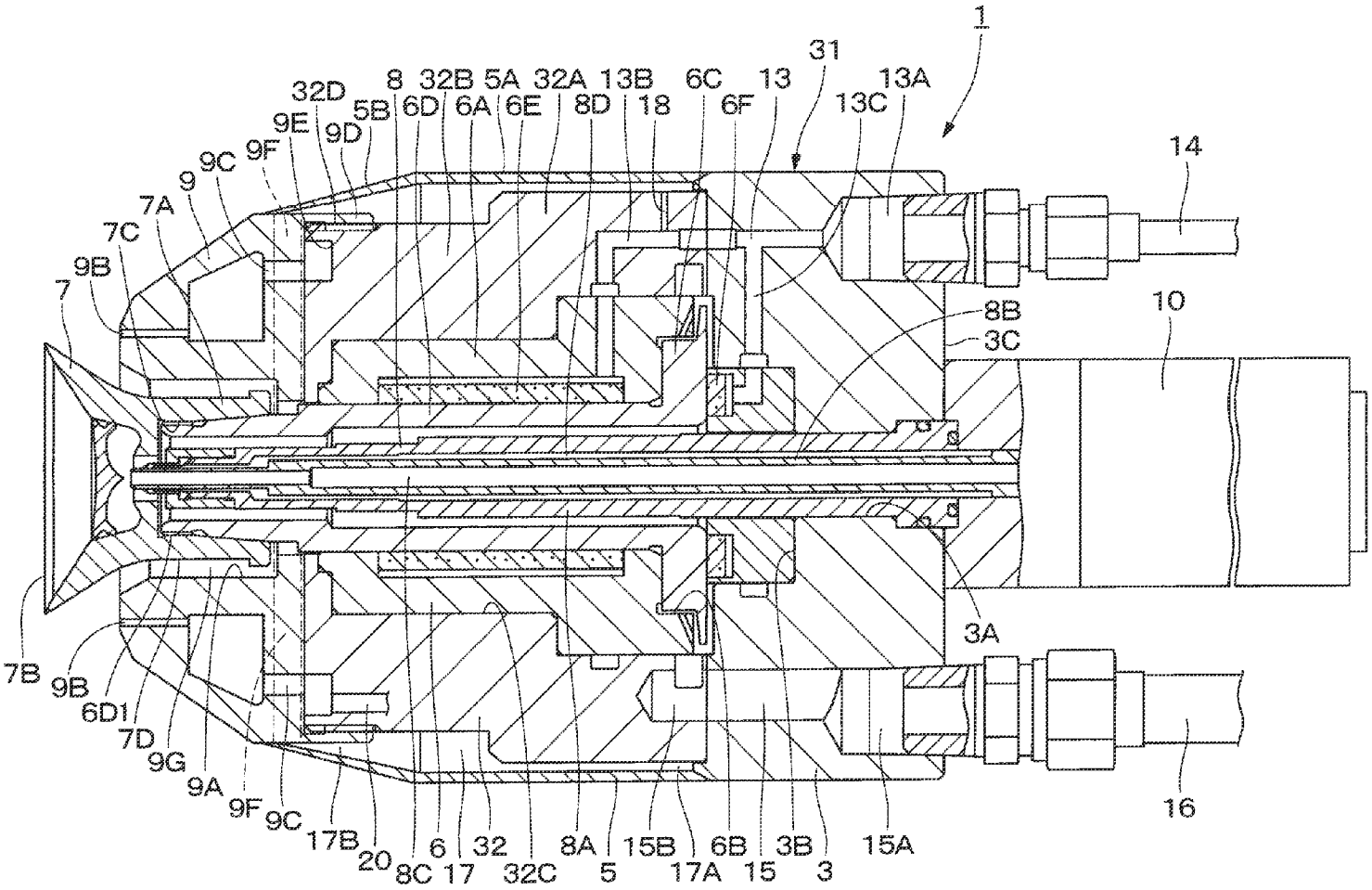
FIG. 9 is a longitudinal sectional view illustrating the rotary atomizing head type coating machine according to a second embodiment of the present invention.

Next, FIG. 9 illustrates a second embodiment of the present invention. A feature of this embodiment is a configuration in which the turbine air branch passage is abolished, and only the bearing air branch passage is provided between the bearing air passage and the annular space. In the second embodiment, component elements that are identical to those in the foregoing first embodiment will be simply denoted by the same reference numerals to avoid repetitions of similar explanations.

In FIG. 9, designated at 31 is a housing according to the second embodiment, and designated at 32 is a front housing part of the housing 31, respectively. This front housing part 32 is composed of a large-diameter tubular portion 32A, a small-diameter tubular portion 32B, a motor accommodating portion 32C, and a male screw portion 32D substantially similarly to the front housing part 4 according to the first embodiment. However, the front housing part 32 according to the second embodiment is different from the front housing part 4 according to the first embodiment in a point that the turbine air branch passage is not provided.

Then, in the second embodiment configured as above, too, the working effect substantially similar to the aforementioned first embodiment can be obtained. Particularly, according to the second embodiment, in the front housing part 32, only the bearing air branch passage 18 for leading the compressed air flowing through the bearing air passage 13 to the annular space 17 is provided as a passage for leading the compressed air to the annular space 17.

In this case, since the bearing air is supplied stably (statically) at a pressure lower than the turbine air, the outflow air flowing out of the annular space 17 can be supplied only in an appropriate amount to the outer peripheral surface 7D side of the rotary atomizing head 7. As a result, a state in which the shaping air is disturbed, and the spraying pattern of the paint becomes unstable such as in the case in which a large amount of air is supplied to the outer peripheral surface 7D side of the rotary atomizing head 7 can be prevented, and the coating finish, reliability and the like can be improved.

It should be noted that, in the first embodiment, the bearing air passage 13 (bearing air branch passage 18) and the turbine air passage 15 (turbine air branch passage 19) are arranged at positions shifted by approximately 90 degrees in the circumferential direction of the housing 2. However, the present invention is not limited to that, and the bearing air passage 13 (bearing air branch passage 18) and the turbine air passage 15 (turbine air branch passage 19) may be arranged at positions shifted by approximately 180 degrees in the circumferential direction of the housing 2, for example. In this case, heat insulating air can be made to flow throughout the annular space 17 by the two air branch passages 18 and 19. Further, the bearing air branch passage 18 and the turbine air branch passage 19 may be configured to be arranged by an angle other than 90 degrees and 180 degrees.

In the first embodiment, the case in which the annular space 17 is formed over the entire length from the rear end to the front end of the front housing part 4 was described as an example. However, the present invention is not limited to that, and the annular space 17 may be formed shorter than the entire length of the front housing part 4, for example. On the other hand, the annular space 17 may be formed longer than the entire length of the front housing part 4. These configurations can be applied also to the second embodiment.

Figure 10:
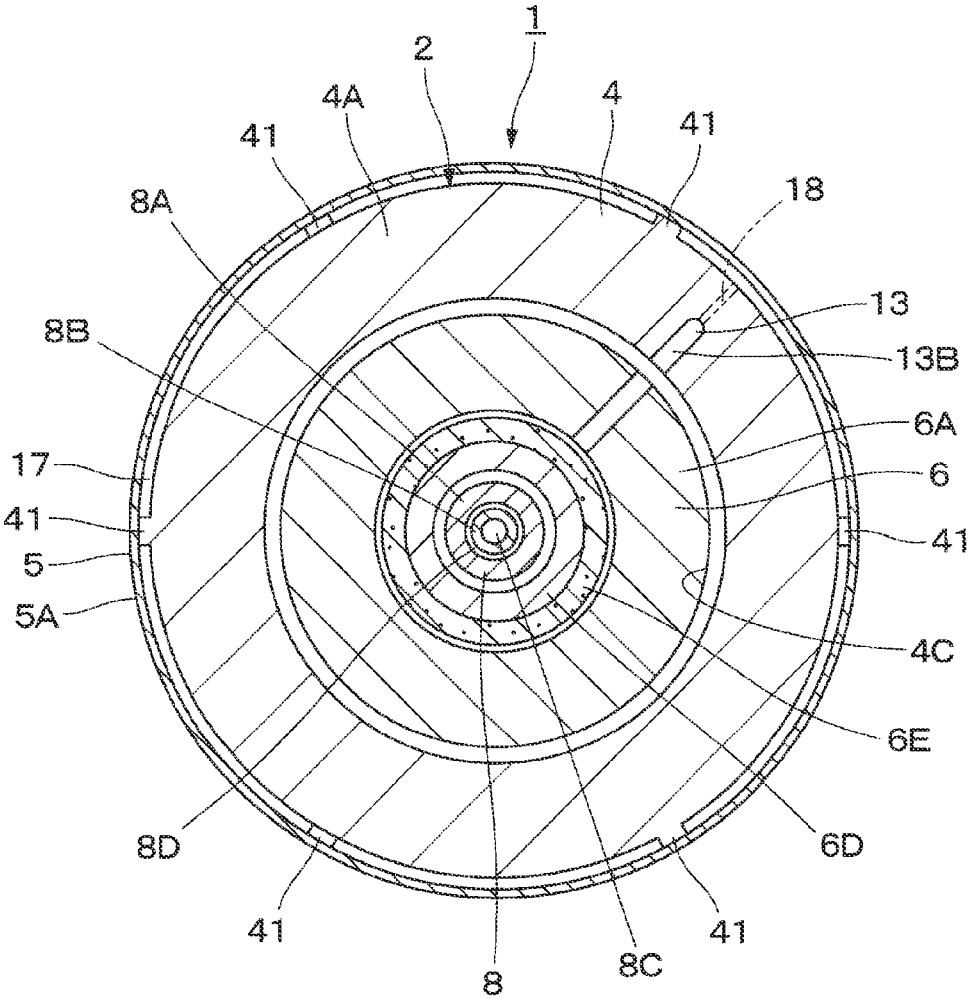
FIG. 10 is a cross sectional view of the rotary atomizing head type coating machine according to a first modification of the present invention when seen from a position similar to that in FIG. 6.

In the first embodiment, the case in which the annular space 17 is formed as an annular space between the front housing part 4 and the cover 5 is illustrated as an example. However, on the annular space 17, supporting projections each having a columnar shape, a plate shape or the like may be provided at intervals in the circumferential direction. That is, as in a first modification illustrated in FIG. 10, it may be configured such that one or a plurality of, for example, three supporting projections 41 protruding outward in the radial direction as one set are provided in plural rows in the length direction between the outer peripheral surface of the front housing part 4 and the cover 5. In this case, even if the supporting projections 41 are provided, by shifting each row of the supporting projections 41 in the circumferential direction (in so-called staggered arrangement), insulating compressed air can be made to flow over the entire periphery of the annular space 17. This supporting projection 41 can position the cover 5 with respect to the front housing part 4, and strength of the cover 5 to the load from the outside can be improved by supporting the cover 5 from the inside.

Figure 11:
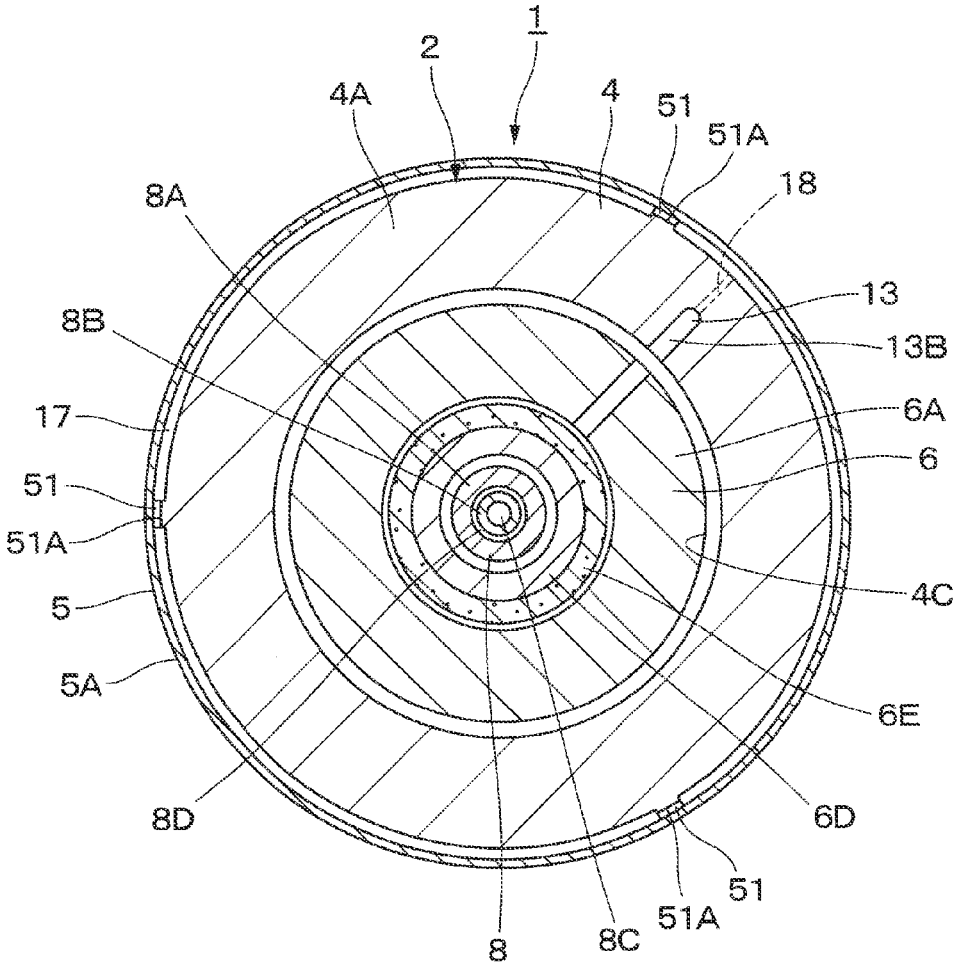
FIG. 11 is a cross sectional view of the rotary atomizing head type coating machine according to a second modification of the present invention when seen from a position similar to that in FIG. 6.

On the other hand, in the annular space 17, one or a plurality of projections (streaks) may be provided over its entire length in configuration. That is, as in a second modification illustrated in FIG. 11, one or a plurality of, for example, three supporting projections 51 protruding outward in the radial direction, while extending over the entire length of the annular space 17 may be provided between the outer peripheral surface of the front housing part 4 and the cover 5 in configuration. In each of the supporting projections 51, a groove-shaped air flow passage 51A is provided by notching in the circumferential direction. As a result, even if the supporting projections 51 are provided over the entire length of the annular space 17, the insulating compressed air can be made to flow over the entire periphery of the annular space 17 through each of the air flow passage 51A. It should be noted that the air flow passage 51A may be formed by a through hole or the like other than the notched groove. These configurations can be applied also to the second embodiment.

In the second embodiment, the case in which only the bearing air branch passage 18 is provided on the housing 31, and the compressed air flowing through the bearing air passage 13 is led to the annular space 17 in configuration is described as an example. However, the present invention is not limited to that but may be configured such that only the turbine air branch passage 19 is provided on the housing 2, and the compressed air flowing through the turbine air passage 15 is led to the annular space 17.

In each of the embodiments, the configuration as a direct charging type electrostatic coating machine which directly applies a high voltage to the rotary atomizing head type coating machine 1 was explained as an example. However, the present invention is not limited to that and may be configured to be applied to an indirect charging type electrostatic coating machine in which a high voltage is applied by an external electrode to the paint particles sprayed from the rotary atomizing head, for example. Moreover, the present invention can be applied also to a non-electrostatic coating machine performing coating without applying a high voltage. In this non-electrostatic coating machine, the housing, the cover, the shaping air ring and the like can be formed of a conductive material, that is, a metal material such as an aluminum alloy and the like, for example.

DESCRIPTION OF REFERENCE NUMERALS

1: Rotary atomizing head type coating machine
2, 31: Housing
3: Rear housing part
4, 32: Front housing part
4C, 32C: Motor accommodating portion
5: Cover
5A: Outer peripheral surface (Surface)
6: Air motor
6A: Motor case
6B: Turbine chamber
6C: Turbine
6D: Rotational shaft
6E: Radial air bearing
6F: Thrust air bearing
7: Rotary atomizing head
8: Feed tube
8C: Paint passage
8D: Wash fluid passage
9: Shaping air ring
9B: Air ejection port
9F: Jig insertion hole
9G: Annular air discharge passage
13: Bearing air passage
13A, 15A: Inlet port
15: Turbine air passage
17: Annular space
18: Bearing air branch passage
19: Turbine air branch passage
20: Shaping air passage

The invention claimed is:

1. A rotary atomizing head type coating machine comprising:

a cylindrical housing whose inner peripheral side is a motor accommodating portion;

a cylindrical cover covering an outer peripheral side of said housing;

an air motor accommodated in said motor accommodating portion of said housing and rotating and driving a rotational shaft supported by an air bearing by a turbine;

a rotary atomizing head located on the front side of said housing and mounted on a distal end portion of said rotational shaft of said air motor and spraying a paint supplied while rotating together with said rotational shaft;

a feed tube provided by being inserted through said rotational shaft and supplying the paint toward said rotary atomizing head;

a shaping air ring provided by surrounding an outer peripheral surface of said rotary atomizing head on the front end side of said housing and having an air ejection port for ejecting shaping air for shaping a spraying pattern of the paint sprayed from said rotary atomizing head;

a bearing air passage provided on said housing, a distal end of the bearing air passage being connected to the air bearing of the air motor, and supplying bearing air toward said air bearing of said air motor; and a turbine air passage provided on said housing and supplying driving air toward said turbine of said air motor, wherein:

an annular space surrounding said air motor is provided between said housing and said cover;

said housing includes an bearing air branch passage that branches from said bearing air passage and connects said bearing air passage and said annular space to each other;

by forming said bearing air branch passage to have a narrower diameter as compared with said bearing air passage, a part of bearing air supplied from said bearing air passage toward said air motor is led to said annular space; and an air discharge passage formed at a position of the outer peripheral surface of said rotary atomizing head, the air discharge passage configured to discharge an outflow air flowing out of said annular space into the atmospheric air at the position of said outer peripheral surface of said rotary atomizing head.

2. The rotary atomizing head type coating machine according to claim 1, wherein said bearing air branch passage is formed so that a small amount of air which does not affect an operation of said air bearing by the bearing air is led into said annular space.

3. The rotary atomizing head type coating machine according to claim 1, wherein said shaping air ring is configured such that a jig insertion hole into which a rod of a rotation-stopping jig for regulating rotation of said rotational shaft is inserted is provided extending in a radial direction;

an opening on the outer diameter side of said jig insertion hole is opened on a downstream end of said annular space; and an opening on the inner diameter side of said jig insertion hole is opened in an atomizing head accommodating hole of said shaping air ring surrounding said outer peripheral surface of said rotary atomizing head.

4. The rotary atomizing head type coating machine according to claim 1, wherein said housing is composed of a rear housing part supporting the base end side of said feed tube and having an inlet port of each of said air passages and a front housing part provided on the front side of said rear housing part and on which said motor accommodating portion is provided;

said cover is arranged at a position covering the outer peripheral side of said front housing part; and said annular space is formed between said front housing part and said cover.

5. The rotary atomizing head type coating machine according to claim 1, wherein said annular space is provided in a range of an axial length corresponding to said motor accommodating portion of said housing.

* * * * *